US008613605B2

(12) United States Patent
Hammar et al.

(10) Patent No.: US 8,613,605 B2
(45) Date of Patent: Dec. 24, 2013

(54) CENTRIFUGAL PUMP

(75) Inventors: John Hammar, Newtown, CT (US); Po Lun Cheng, Hong Kong (CN); Min Li, Shenzhen (CN)

(73) Assignee: Johnson Electric S.A., Murten (CH)

( * ) Notice: Subject to any disclaimer, the term of this patent is extended or adjusted under 35 U.S.C. 154(b) by 460 days.

(21) Appl. No.: 12/765,353

(22) Filed: Apr. 22, 2010

(65) Prior Publication Data

US 2010/0272562 A1 Oct. 28, 2010

(30) Foreign Application Priority Data

Apr. 24, 2009 (CN) ..... 2009 1 0107131

(51) Int. Cl.
*F04B 35/04* (2006.01)

(52) U.S. Cl.
USPC ..... 417/423.7; 417/423.14; 415/204; 415/206; 415/119

(58) Field of Classification Search
USPC ..... 417/423.7, 423.14; 415/204, 206, 225, 415/208.1, 208.2, 169.1, 169.2, 144, 212.1, 415/123, 169 R, 119
See application file for complete search history.

(56) References Cited

U.S. PATENT DOCUMENTS 1,433,762 A * 10/1922 Wallick ..... 415/121.3
1,817,169 A * 8/1931 Schwitzer et al. ..... 415/208.1
3,279,386 A * 10/1966 Rupp et al. ..... 415/147
3,316,848 A * 5/1967 Egger ..... 415/204
3,322,071 A * 5/1967 Teter ..... 415/196
4,177,008 A * 12/1979 Florjancic et al. ..... 415/206
4,518,311 A * 5/1985 Dernedde et al. ..... 415/102
4,661,041 A * 4/1987 Hessler ..... 415/58.4
4,661,085 A * 4/1987 Carli ..... 464/160
4,799,287 A * 1/1989 Belanger et al. ..... 15/405
5,156,522 A * 10/1992 Tessier ..... 415/58.2
5,156,535 A * 10/1992 Budris et al. ..... 417/423.7
5,332,369 A * 7/1994 Jensen ..... 417/369
5,484,259 A * 1/1996 Ahmed et al. ..... 415/119
5,613,845 A * 3/1997 Moon ..... 417/423.11
5,618,168 A * 4/1997 Moon ..... 417/423.11
5,701,388 A * 12/1997 Steinhardt et al. ..... 392/471
5,839,879 A * 11/1998 Kameoka et al. ..... 415/206
5,930,852 A * 8/1999 Gravatt et al. ..... 4/541.1
6,056,506 A * 5/2000 Martin et al. ..... 415/204
6,102,657 A * 8/2000 Chalberg et al. ..... 415/204
6,264,441 B1 * 7/2001 Marioni ..... 417/423.1
6,428,271 B1 * 8/2002 Ress et al. ..... 415/169.1
6,494,152 B2 * 12/2002 Gatley, Jr. ..... 110/341
7,055,866 B2 * 6/2006 Tempas ..... 285/148.23
7,470,106 B1 * 12/2008 Blattmann ..... 415/196

(Continued)

*Primary Examiner* — Charles Freay
*Assistant Examiner* — Ryan Gatzemeyer
(74) *Attorney, Agent, or Firm* — Muncy, Geissler, Olds & Lowe, PLLC

(57) ABSTRACT

A centrifugal pump includes a pump unit and a drive unit. The pump unit includes a volute and an impeller disposed in the volute. The drive unit includes a stator and a rotor having a shaft. The volute includes an inlet, an outlet and a chamber in communication with the inlet and outlet. The shaft of the rotor extends into the chamber of the volute and the impeller is attached to and driven by the shaft. The volute further includes a transition part connected between the outlet and the chamber and communicating the outlet with the chamber. The axis of the transition part is angled to the axis of the outlet. The transition part is configured to improve the effect of fluid turbulence to thereby reduce noise, especially in the air-water stage.

23 Claims, 5 Drawing Sheets

(56) References Cited

U.S. PATENT DOCUMENTS 7,544,041 B2 * 6/2009 Mayleben et al. ..... 415/171.1
7,832,984 B2 * 11/2010 Harman ..... 415/204
2008/0080987 A1 4/2008 Zhang et al.
2008/0213089 A1 * 9/2008 McCurry et al. ..... 415/204

* cited by examiner

CENTRIFUGAL PUMP

CROSS REFERENCE TO RELATED APPLICATIONS

This non-provisional patent application claims priority under 35 U.S.C. §119(a) from Patent Application No. 200910107131.9 filed in The People's Republic of China on Apr. 24, 2009.

FIELD OF THE INVENTION

This invention relates to a centrifugal pump and in particular, to a centrifugal drain pump for a washing machine or the like.

BACKGROUND OF THE INVENTION

Centrifugal pumps are often used as drain pumps in washing machines or dishwashers. In actual application, the pump is mounted inside of the machine and activated automatically during operation by the control circuit of the machine, mainly to pump out the water from the machine. The whole operation can be divided into three stages: the starting stage, the full water stage and the air-water stage. The air-water stage is the last stage during which most of the water has already been pumped out and only residual water mixed with air, flows through the pump. In general, the air-water stage is the noisiest phase of operation, with the noise level significantly greater than the noise level of the starting or full water stages.

SUMMARY OF THE INVENTION

Hence there is a desire for a quieter centrifugal pump, especially when the pump is operating in the air-water stage.

This is achieved in the present invention by providing a transition part between the pump chamber and the outlet of the pump, which transition part has an axis which is angled to the axis of the outlet.

Accordingly, in one aspect thereof, the present invention provides a centrifugal pump comprising: a pump unit comprising a volute and an impeller disposed in a chamber of the volute; and a drive unit comprising a stator and a rotor including a shaft; wherein the volute comprises an inlet, an outlet and a chamber in communication with the inlet and outlet; the shaft of the drive unit extends into the chamber of the volute and the impeller is attached to and driven by the shaft; and the volute further comprises a transition part communicating the outlet with the chamber, the axis of the transition part being angled to the axis of the outlet.

Preferably, the axis of the outlet is offset from the axis of the impeller.

Preferably, the impeller has an axis which is located in a first horizontal plane and the outlet has an axis which is located in a second horizontal plane, the second horizontal plane is disposed vertically below the first horizontal plane.

Preferably, the outlet is disposed below the first horizontal plane.

Preferably, the axis of the inlet is offset from the axis of the impeller.

Preferably, the impeller is located at the center of the chamber, and an inclined part is connected between the inlet and the chamber, the axis of the inclined part being inclined relative to the axis of the inlet.

Preferably, the axis of the inlet is parallel to the axis of the impeller.

Preferably, a baffle is disposed in the inclined part, the baffle comprising a guiding surface configured to avoid a dead space formed in the inclined part, a passageway for the main flow of the fluid through the inclined part and a drain hole.

Preferably, the drain hole is located in the lower most portion of the baffle and communicates with a drain aperture in the volute.

Preferably, the baffle further comprises a bleed passage formed in an upper most portion of the baffle.

Preferably, at least one of the drain hole and the bleed passage cooperates with a projection on the volute to locate the baffle within the inclined part.

Alternatively, the impeller is located at the center of the chamber, and the inlet is connected directly to the chamber.

Preferably, the rotor comprises a permanent magnet attached to the shaft, and the stator comprises a mounting structure having a mounting plate attached to the volute and a hollow cylinder extending from one side of the mounting plate, the shaft and magnet being disposed in the cylinder.

Preferably, the drive unit is a synchronous motor and the stator comprises a stator core located outside of the cylinder with pole faces confronting the rotor, and at least one stator winding wound about the stator core.

Preferably, the impeller is connected to the shaft by a lost motion clutch.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labelled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
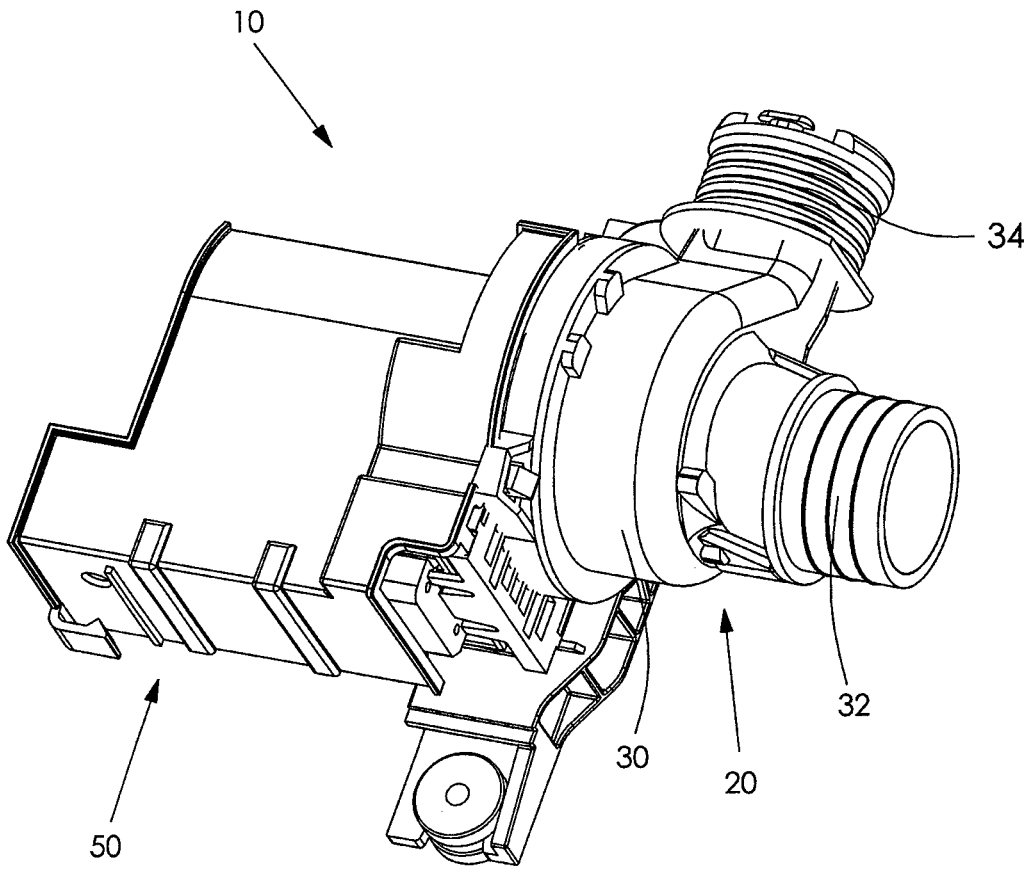
FIG. 1 is an isometric view of a centrifugal pump in accordance with a first embodiment of the present invention.
Figure 2:
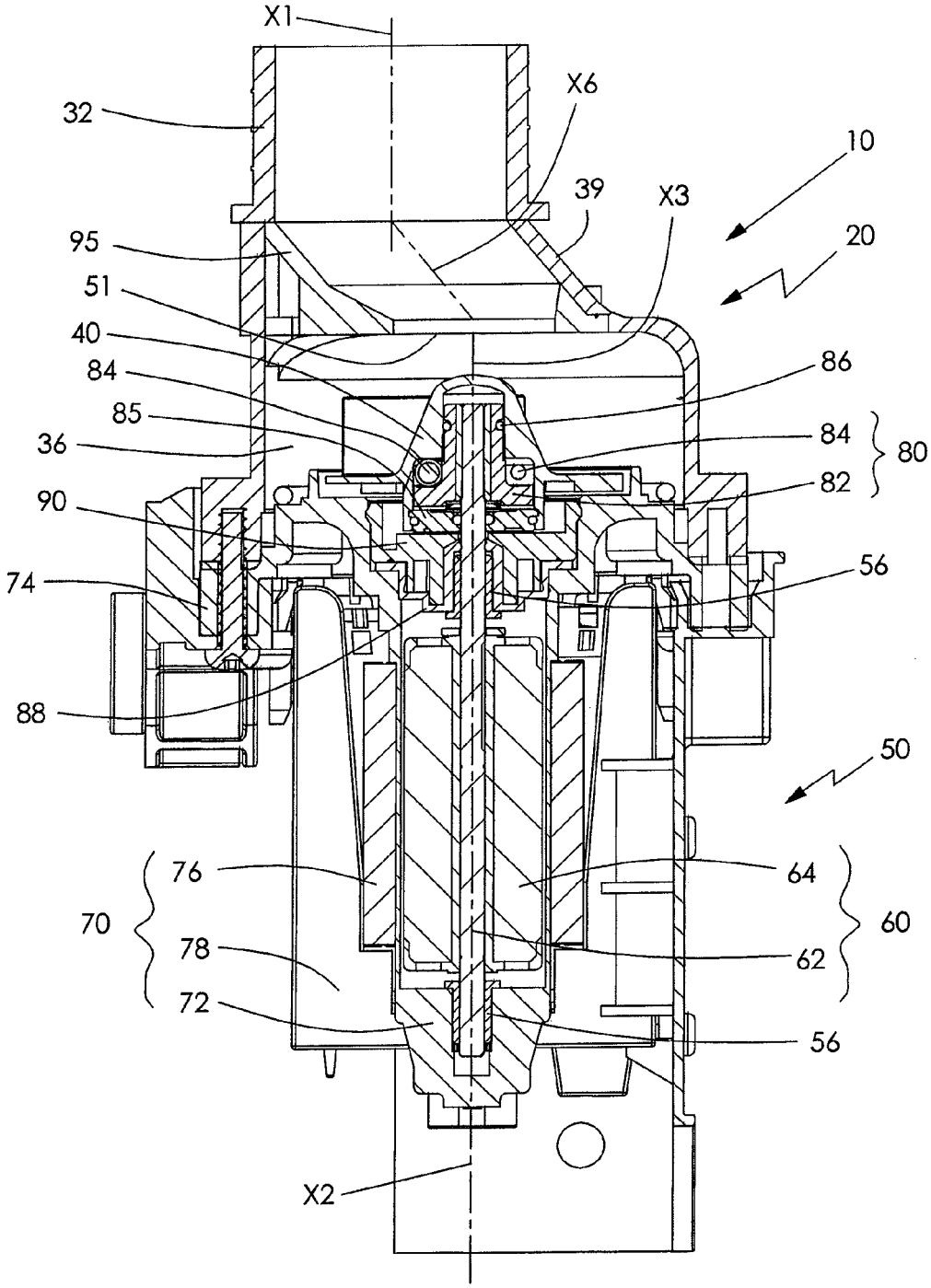
FIG. 2 is a cross sectional view of the pump of FIG. 1.

A centrifugal pump 10, according to a preferred embodiment of the present invention as shown in FIGS. 1 and 2, comprises a pump unit 20 and a drive unit 50. The pump unit 20 comprises a volute 30 and an impeller 40 disposed within the volute 30. The drive unit 50 is preferably, a synchronous motor with a permanent magnet rotor 60 and a wound stator 70.

Figure 3:
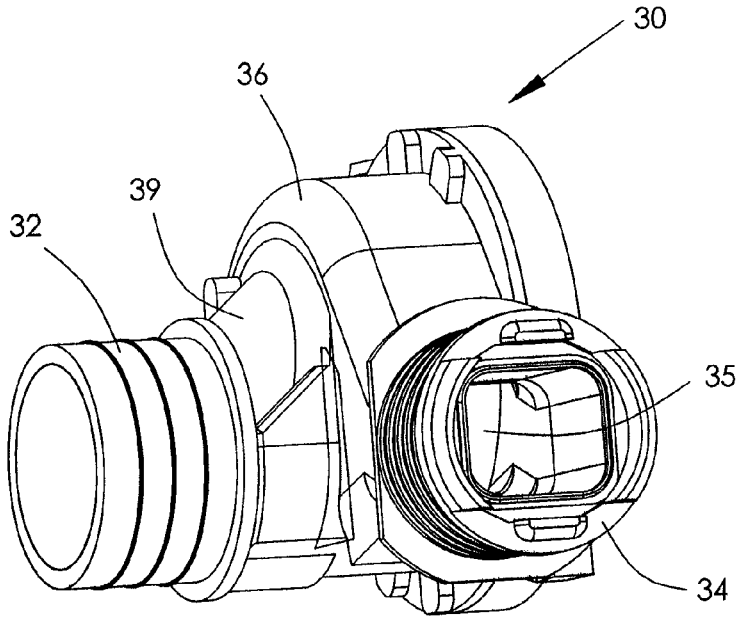
FIG. 3 is an isometric view of a volute, being a part of the pump of FIG. 1.
Figure 4:
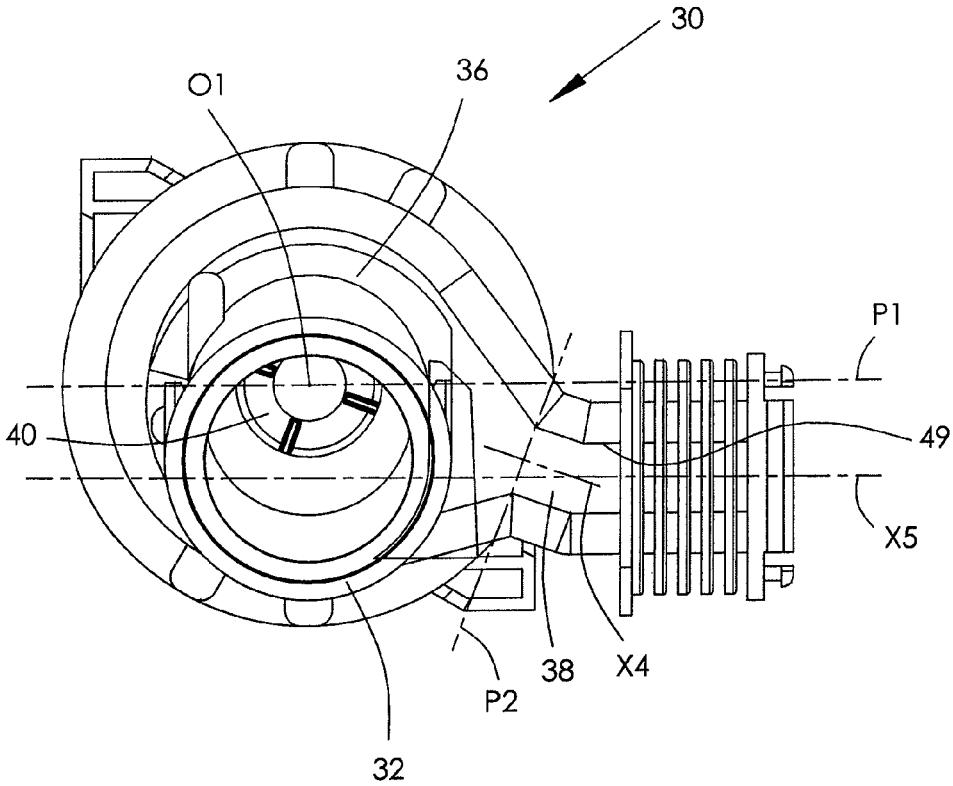
FIG. 4 is a different view of the volute of FIG. 3, with an impeller being shown.

The volute 30, as shown more clearly in FIGS. 3 and 4, comprises an inlet 32, an outlet 34 and a chamber 36 in communication with the inlet 32 and outlet 34. The orientation of the inlet 32 is perpendicular to the plane of the outlet 34. The impeller 40 is located in the center of the chamber 36 and the axis X2 of the impeller 40 is coaxial with the axis X3 of the chamber 36. The axis X2 of the impeller 40 passes through the center O1 of the impeller 40.

A transition part (preferably a transition tube) 38 is provided between the outlet 34 and the exit aperture 35 of chamber 36. The axis X4 of the transition part 38 is angled to the axis X5 of the outlet 34, such that the axis X5 of the outlet 34 does not cross the axis X2 of the impeller. Ideally, the axis X5 of the outlet 34 extends horizontally from the chamber at a location which is below the axis X2 of the impeller which also extends horizontally in a direction which is perpendicular to the outlet axis X5 but in a horizontal plane which is above the horizontal plane containing the outlet axis X5. The transition part 38 is arranged to reduce turbulence in the fluid flowing from the chamber to the outlet to thereby reduce noise, especially during the air-water stage. The air-water stage is when the pump is operating to pump water but there is a large amount of air in the pump, as occurs, for example, when the pump is starting to run dry at the end of the pumping cycle.

Ideally, in use, the pump is mounted such that the axis of the impeller lies in a horizontal plane (represented by P1 in FIG. 4). The axis of the outlet also lies in a horizontal plane which is located below the horizontal plane P1 of the impeller such that the axis of the outlet is located below the axis of the impeller. However, the exit aperture 35 of the chamber lies in a plane represented by P2 in FIG. 4 with the transition part forming the connecting passage between the exit aperture 35 and the outlet. It has been found that this arrangement produces less noise in the air-water stage. Preferably, the upper inner surface 49 of the outlet is located below the horizontal plane P1 of the impeller axis. It is thought that the reduction in noise is brought about, during the air-water stage, by water contained in the outlet 34 preventing air contained in the volute chamber 36 from escaping to the outside via the outlet. Thus the water in the outlet helps to form a barrier to the movement of the air through the outlet by forming something akin to a water trap. The larger the offset between the horizontal planes of the impeller axis and the outlet axis the greater the effect of the water trap.

Preferably, an inclined part (preferably an inclined tube) 39 is provided between the inlet 32 and the entrance 51 of the chamber 36. The axis X6 of the inclined part 39 being inclined relative to the axis X1 of the inlet. It is a part of the passage which connects the inlet to the entrance or opening in the wall of the chamber. The inclined part 39 allows the axis X1 of the inlet 32 to be offset from the axis X3 of the chamber 36. That is, the axis X1 of the inlet 32 is offset from the axis X2 of the impeller 40. The chamber axis is defined as the axis of the impeller as the chamber surrounds the impeller. It has been found that by offsetting the axis of the inlet from the impeller axis, the pump is quieter. It is thought that the inclined part 39 improves the turbulence of the flow of fluid from the inlet to the chamber to thereby reduce noise. The inclined part 39 allows the entrance to the chamber to be coaxial with the impeller axis while allowing the axis of the inlet to be offset from the impeller axis.

Figure 5:
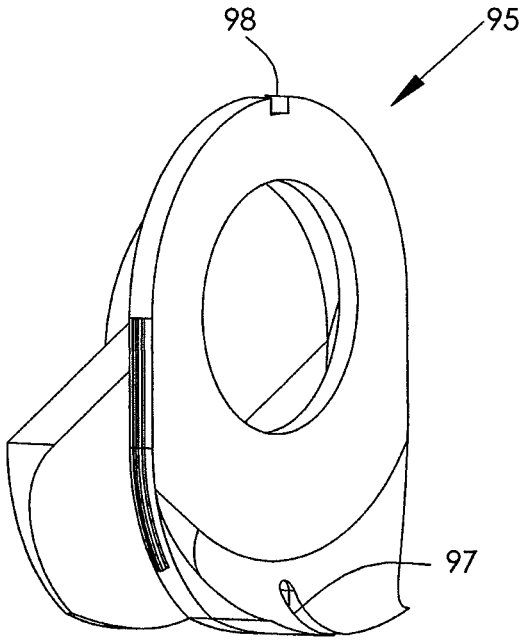
FIG. 5 is an isometric view of a baffle, being a part of the pump of FIG. 1.
Figure 6:
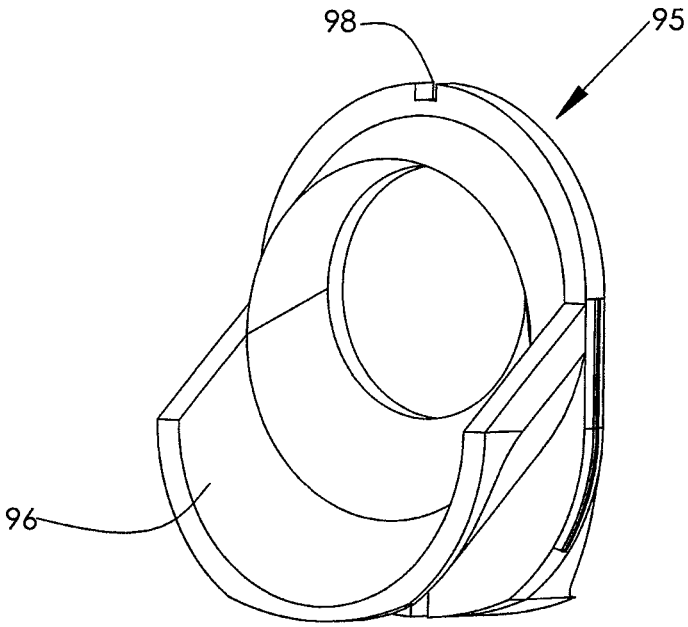
FIG. 6 is a different view of the baffle of FIG. 5.

Referring to FIGS. 3 and 5-6, an optional baffle 95 is disposed in the inclined part 39. The baffle 95 comprises a guide surface 96 which is arranged to avoid a dead space being formed adjacent a corner of the inclined part 39. The baffle 95 is inserted into the passage of the inclined part and smoothes the flow path through the inclined part. In forming the inclined part, due to the molding technique, there may be formed a corner or portion of the passage where the inlet is not aligned with the entrance in the chamber which is an abrupt edge. This corner causes severe turbulence and if left as is would generate a dead space in the flow through the inlet and generate noise. This corner or dead space is generally located at the bottom or lower portion of the inclined portion, when the motor is mounted to the machine. The baffle 95 has a drain hole 97 passing through the dead space and into the chamber 36. The drain hole allows the residual water or fluid in the pump chamber to drain out into the inlet under gravity when the pump is turned off. A small bleed passage 98 at the top of the baffle allows air in the pump to be bled out of the chamber when the pump is filling with water prior to turning the pump on. This reduces the noise during the startup phase. The drain hole 97 and/or the bleed passage 98 may cooperate with a ridge or projection on the volute to correctly locate and retain the baffle.

As shown in FIG. 2, the rotor 60 comprises a shaft 62 and magnets 64 attached to the shaft 62.

The stator 70 comprises a mounting structure which comprises a hollow cylinder 72 configured to receive the rotor 60 therein, and a mounting plate 74 disposed at one end of the cylinder 72. The mounting plate 74 defines a plurality of mounting holes for engagement of screws to thereby secure the drive unit 50 and the pump unit 20 together. One end of the shaft 62 is mounted to the mounting plate 74 and the other of the shaft is mounted to the end of the cylinder 72 remote from the mounting plate 74 via bearings 56. The end of the shaft 62 mounted to the mounting plate 74 extends through the mounting plate 74 to be connected to the impeller 40, preferably by a lost motion clutch which reduces the starting torque required to operate the pump under full load. As shown the impeller is connected to the shaft via a coupling device 80 disposed inside of the hub 42 of the impeller 40.

The coupling device 80 may be the coupling device disclosed in published US patent application No. 2008/0080987 the content of which is incorporated herein by reference. The coupling device 80 comprises a tube 82 fixedly mounted to the end of the shaft 62, and balls 84 arranged between the inner surface of the hub 42 of the impeller 40 and the tube 82. The tube 82 has driving teeth extending outwardly in radial directions and the inner surface of the hub 42 has driven teeth extending inwardly in radial directions. When the shaft 62 rotates, the driving teeth of the tube 82 drive the driven teeth of the hub 42 and therefore the impeller 40 to rotate via the balls 84. The inner surface of the end of the hub 42 facing the drive unit 50 defines an annular slot. A cover 85 with a flange is mounted to the end of the hub 42 and the flange of the cover 85 is engaged in the slot of the hub 42 to prevent the coupling device 80 escaping from the inside of the hub 42. Preferably, an elastic or rubber member is axially disposed between the cover 85 and the tube 82. An elastic ring 86 is engaged between the outer surface of the tube 82 and the inner surface of the hub 42 away from the balls 84, to prevent the impeller 40 from wobbling when the impeller 40 rotates. A sealing structure 88 is disposed between the bearing 56 and a mounting structure 90 installed in a mounting opening of the mounting plate 74, to prevent fluid in the pump unit 20 from entering into the drive unit 50 along the shaft 62.

The stator comprises a stator core 76 surrounding the cylinder 72 and windings wound on the stator core 76. An enclosure 78 is attached to the mounting plate 74 and encloses the stator core 76 and windings therein.

Figure 7:
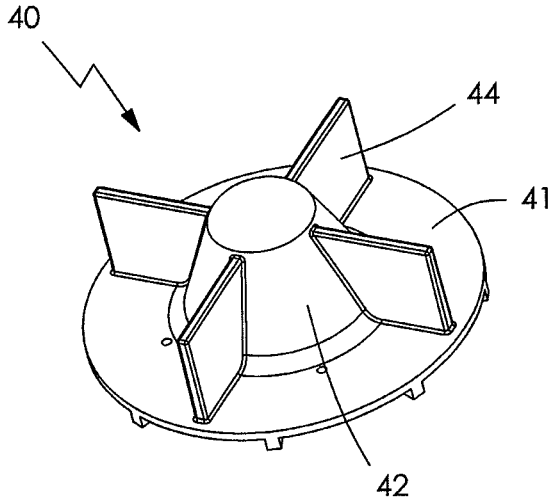
FIG. 7 is an isometric view of an impeller of the pump of FIG. 1.

Referring to FIG. 7, the impeller 40 comprises a bottom plate 41, the hub 42 and blades 44 extending radially from the hub 42. Preferably, the hub 42 has a cone shape.

Figure 8:
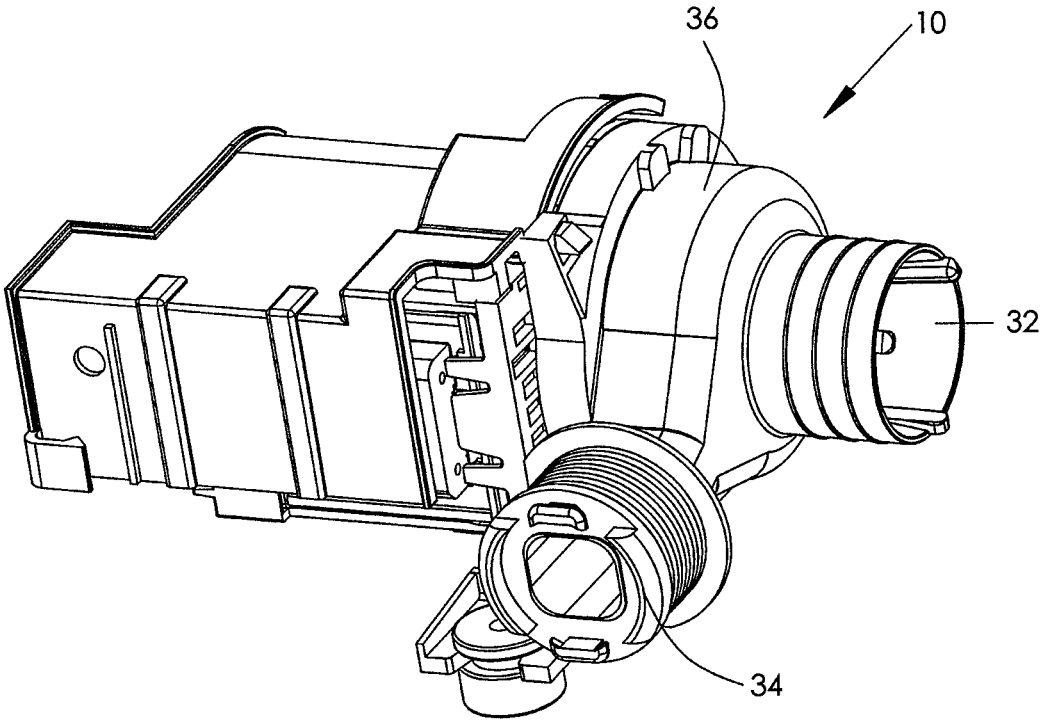
FIGS. 8 and 9 show a volute in accordance with a second embodiment of the present invention.
Figure 9:
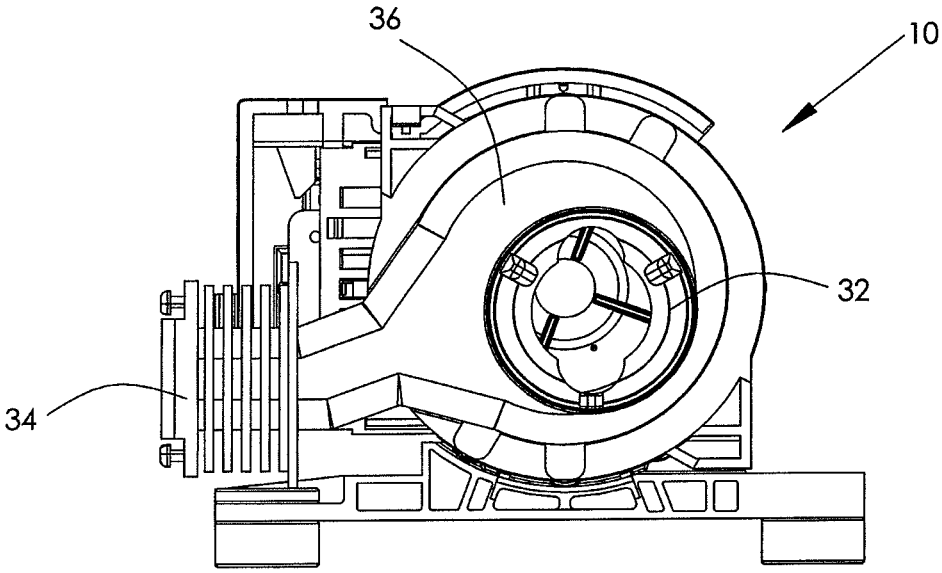

FIGS. 8 and 9 show a pump in accordance with another embodiment of the present invention. This pump is similar to the pump described herein before except for the volute 30. The inlet 32 of the volute 30 is connected with the chamber 36 directly without using the inclined part 39 described above. The entrance of the chamber 36 is offset from the axis of the impeller 40. The inlet 32 is aligned with the chamber entrance. Thus, the axis of the inlet 32 is offset from the axis of the impeller 40. In this embodiment, the use of the baffle 95 is not required.

The pump of the present invention may be used in any kind of washing machine.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A centrifugal pump comprising:

a pump unit comprising a volute and an impeller disposed in a chamber of the volute; and a drive unit comprising a stator and a rotor including a shaft;

wherein the volute comprises an inlet and an outlet in communication with the chamber;

the shaft of the drive unit extends into the chamber of the volute and the impeller is attached to and driven by the shaft; and the volute further comprises a transition part communicating the outlet with the chamber, an axis of the transition part being angled to an axis of the outlet, the transition part being arranged between the outlet and an exit aperture of the chamber;

wherein in use the pump is mounted such that the axis of wherein in use the pump is mounted such that the axis of the outlet is located below a center of the impeller for reducing noise caused by fluid contained in the outlet preventing air in the volute chamber from escaping via the outlet.

2. The centrifugal pump of claim 1, wherein the rotor comprises a permanent magnet attached to the shaft, and the stator comprises a mounting structure having a mounting plate attached to the volute and a hollow cylinder extending from one side of the mounting plate, the shaft and magnet being disposed in the cylinder.

3. The centrifugal pump of claim 2, wherein the drive unit is a synchronous motor and the stator comprises a stator core located outside of the cylinder with pole faces confronting the rotor, and at least one stator winding wound about the stator core.

4. A centrifugal pump comprising:

a pump unit comprising a volute and an impeller disposed in a chamber of the volute; and a drive unit comprising a stator and a rotor including a shaft;

wherein the volute comprises an inlet and an outlet in communication with the chamber;

the shaft of the drive unit extends into the chamber of the volute and the impeller is attached to and driven by the shaft; and the volute further comprises a transition part communicating the outlet with the chamber, an axis of the transition part being angled to an axis of the outlet, the transition part being arranged between the outlet and an exit aperture of the chamber;

wherein an axis of the inlet is offset from an axis of the impeller in a radial direction of the impeller perpendicular to the axis of the outlet; wherein the distance between the axis of the inlet and the axis of the outlet is smaller than the distance between the axis of the impeller and the axis of the outlet.

5. The centrifugal pump of claim 4, wherein the impeller is located at the center of the chamber, and an inclined part is connected between the inlet and an entrance of the chamber, an axis of the inclined part being inclined relative to the axis of the inlet.

6. The centrifugal pump of claim 5, wherein the axis of the inlet is parallel to the axis of the impeller.

7. The centrifugal pump of claim 5, wherein a baffle is disposed in the inclined part, the baffle comprising a guiding surface configured to avoid a dead space formed in the inclined part, a passageway for the main flow of the fluid through the inclined part and a drain hole.

8. The centrifugal pump of claim 7, wherein the drain hole is located in the lower most portion of the baffle and communicates with a drain aperture in the volute.

9. The centrifugal pump of claim 8, wherein the baffle further comprises a bleed passage formed in an upper most portion of the baffle.

10. The centrifugal pump of claim 4, wherein the impeller is located at the center of the chamber, and the inlet is connected directly to the chamber.

11. A centrifugal pump comprising:

a pump unit comprising a volute and an impeller disposed in a chamber of the volute; and a drive unit comprising a stator and a rotor including a shaft;

wherein the volute comprises an inlet and an outlet in communication with the chamber;

wherein the shaft of the drive unit extends into the chamber and the impeller is attached to and driven by the shaft;

wherein the volute further comprises a transition part communicating the outlet with the chamber, an axis of the transition part being angled to an axis of the outlet;

wherein an inclined part is connected between the inlet and the chamber, and a baffle is disposed in the inclined part, the baffle comprising a drain hole and a bleed passage; and wherein at least one of the drain hole and the bleed passage cooperates with a projection on the volute to locate the baffle within the inclined part; wherein in use the pump is mounted such that the axis of the outlet is located below a center of the impeller for reducing noise caused by fluid contained in the outlet preventing air in the volute chamber from escaping via the outlet.

12. A centrifugal pump, comprising:

a volute having a chamber and an inlet in communication with a central portion of the chamber;

a motor having a shaft extending into the chamber of said volute;

an impeller disposed in the chamber of said volute and attached to the shaft of said motor;

a transition part having a first end in communication with a circumferential portion of the chamber of said volute and a second end, wherein an axis thereof is substantially perpendicular to the shaft of said motor;

an outlet attached to the second end of said transition part, wherein an axis of thereof is at an angle with respect the axis of said transition part and substantially perpendicular to the shaft of said motor; and an axis of the impeller is perpendicular to a plane defined by the axis of the outlet and the axis of the transition part;

wherein in use the pump is mounted such that the axis of the outlet is located below a center of the impeller for reducing noise caused by fluid contained in the outlet preventing air in the volute chamber from escaping via the outlet.

13. The centrifugal pump of claim 12 wherein, when viewed from the inlet, the axis of the outlet is offset from a center of the impeller.

14. The centrifugal pump of claim 13, wherein an entire inner surface of the outlet is offset from the center of the impeller in a radial direction of the impeller perpendicular to the axis of the outlet.

15. The centrifugal pump of claim 12, wherein the impeller is connected to the shaft by a lost motion clutch.

16. The centrifugal pump of claim 12, wherein the axis of the outlet is perpendicular to an axis of the inlet.

17. The centrifugal pump of claim 12, wherein an axis of the impeller is located in a first horizontal plane and the axis of the outlet is located in a second horizontal plane vertically below the first horizontal plane.

18. The centrifugal pump of claim 12, wherein an extension of the axis of the transition part intersects an axis of the impeller.

19. The centrifugal pump of claim 12, wherein in use the pump is mounted such that the axis of the outlet is located below a center of the impeller.

20. The centrifugal pump of claim 19, wherein an upper inner surface of the outlet is disposed below the center of the impeller.

21. A centrifugal pump comprising:

a volute having a chamber, an inlet and an outlet which are in communication with the chamber;

a motor having a shaft extending into the chamber of said volute;

an impeller disposed in the chamber of said volute and attached to the shaft of said motor; and a transition part between the chamber and the outlet, an axis of the transition part being at an angle with respect an axis of the outlet and intersecting the shaft; wherein in use the pump is mounted such that the axis of the outlet is located below a center of the impeller for reducing noise caused by fluid contained in the outlet preventing air in the volute chamber from escaping via the outlet.

22. The centrifugal pump of claim 21, wherein in use the pump is mounted such that the axis of the outlet is located below a center of the impeller.

23. The centrifugal pump of claim 21, wherein the axis of the impeller is perpendicular to a plane defined by the axis of the outlet and the axis of the transition part.

* * * * *